US006762354B2

(12) United States Patent
Cocca

(10) Patent No.: US 6,762,354 B2
(45) Date of Patent: Jul. 13, 2004

(54) BEATER

(76) Inventor: Donato Cocca, chaussée de Waterloo 236, B-1060, Brussels (BE)

( * ) Notice: Subject to any disclaimer, the term of this patent is extended or adjusted under 35 U.S.C. 154(b) by 0 days.

(21) Appl. No.: 10/218,808

(22) Filed: Aug. 13, 2002

(65) Prior Publication Data

US 2003/0047060 A1 Mar. 13, 2003

Related U.S. Application Data

(63) Continuation-in-part of application No. PCT/BE01/00024, filed on Feb. 16, 2001.

(30) Foreign Application Priority Data

Feb. 17, 2000 (BE) ..... 2000/0129

(51) Int. Cl.[7] ..... G10D 13/02
(52) U.S. Cl. ..... 84/422.1; 84/422.2
(58) Field of Search ..... 84/422.1, 422.2, 84/422.3

(56) References Cited

U.S. PATENT DOCUMENTS 4,186,644 A * 2/1980 Kurosaki ..... 84/422.1
4,945,803 A * 8/1990 Norwood ..... 84/422.1
5,388,494 A * 2/1995 Hoshino ..... 84/422.1
5,427,010 A * 6/1995 Hoshino ..... 84/422.1
6,137,040 A * 10/2000 Hoshino ..... 84/422.1
6,255,574 B1 * 7/2001 Sapienza ..... 84/422.1

* cited by examiner

*Primary Examiner*—Kimberly Lockett
(74) *Attorney, Agent, or Firm*—Hovey Williams LLP

(57) ABSTRACT

A beater for striking a bass drum comprising a support, a shaft borne by said support, an intermediate part with a recess for receiving a bearing so that said intermediate part is swivel mounted on the shaft, an element bearing the head attached to the intermediate part, a foot mechanism acting on the intermediate part for moving the head towards the head, and a return mechanism for moving the head away from the drum.

22 Claims, 15 Drawing Sheets

BEATER

The present application is a Continuation in part of co-pending International application No. PCT/BE01/00024, with an international filing date of Feb. 16, 2001, published in French under PCT Article 21(2) on Aug. 23, 2001 which claims the benefit of the priority of Belgian patent application BE2000/0129 filed on Feb. 17, 2000.

FIELD OF THE INVENTION

The invention relates to a beater for sticking a drum, said beater comprising an element which is swivel-mounted in relation to an axis, said element bearing a head which is intended to strike the drum and being associated to a return mechanism.

THE PRIOR ART

Commercial beater for striking a drum comprises an element which is swivel-mounted in relation to an axis, said element bearing a head which is intended to strike the drum and which is connected to a mechanism operated by the foot in order to displace the head towards the drum and to a return mechanism for moving said head away from said drum, said beater comprising a support, and a shaft which is borne by said support and on which said element is mounted.

Beaters of this known type are of complicated construction and result in considerable fatigue for the drummer.

Beaters are also disclosed in U.S. Pat. No. 5,388,494. The beater of this document comprises a support with two legs between which a rotating shaft extends. The shaft is mounted on said legs with interposition of bearings. An element bearing the head intended to strike the drum is fixedly mounted on the shaft. A further element is fixedly mounted on said shaft, said further element being connected to the mechanism operated by the foot. The operation of the foot mechanism provokes the rotation of the shaft, whereby the movement of the head for striking the drum. The shaft has a hexagonal cross section for preventing movement of elements fixedly attached thereto, during the operation of the foot mechanism.

The present invention aims to beater of simple construction, enabling an easy use of the beater and/or enabling specific use of the beater, whereby enabling to obtain specific sounds or rhythms.

BRIEF DESCRIPTION OF THE INVENTION

The beater of the invention intended for striking a drum comprises an element which is swivel-mounted in relation to an axis, said element bearing a head which is intended to strike the drum and which is connected to a mechanism operated by the foot in order to displace the head towards the drum and to a return mechanism for moving said head away from said drum, said beater comprising a support, and a shaft which is borne by said support and on which said element is mounted.

The beater according to the invention comprises an intermediate part having a recess intended to receive at least part of at least one bearing mounted on the shaft so that said intermediate part can swivel about the shaft, whilst said element is mounted on said intermediate part. The return mechanism is designed in order to exert a return force on a said intermediate part or on a piece attached to said intermediate part. Although the shaft can be mounted so that it can move in relation to the support, it is advantageously fixed in relation to said support.

In one particular embodiment of a beater according to the invention, the intermediate part or a piece or component attached thereto comprises a means of fixation for a first part or end of the return means, said means being designed in order to fix said first part or end at a point which is distant from the axis of the shaft about which the intermediate part can swivel, whilst the return means comprises a second part or end which is connected to said support by a system which is swivel-mounted on said support. Possibly, abutments can be provided for limiting the swivel movement of the system.

The beater preferably comprises a means which is capable of being displaced between a position which enables said system to be swivelled and a position which substantially prevents any swivelling of said system.

According to one particular embodiment, the return means has an inoperative position in which the first part or end and the second part or end of the return means extend substantially in a plane in which the swivelling axis of the intermediate part and the swivelling axis of the system extend. This means that in its inoperative position the return means exerts a force in a direction which extends in the plane which passes through or which is defined by the swivelling axis of the intermediate part and the swivelling axis of the system.

According to another particular embodiment, the return means has an inoperative position in which the first part or end and the second part or end of the return means extend substantially along a straight line or axis which intersects the swivelling axis of the intermediate part, and a return position (a position in which the return means tends to return the parts which it joins into the inoperative position) in which the first part or end and the second part or end of the return means extend substantially along a straight line or axis which is remote from the swivelling axis and which is inclined in relation to the plane in which the swivelling axis of the intermediate part and the swivelling axis of the system extend. According to one possible detail of this embodiment, a stop limits the swivelling of the system so that the return means has an inoperative position in which the first part or end and the second part or end of the return means extend substantially along a straight line or axis which intersects the swivelling axis of the intermediate part, and a return position (a position in which the return means tends to return the parts which it joins into the inoperative position) in which the first part or end and the second part or end of the return means extend substantially along a straight line or axis which is inclined in relation to the plane in which the swivelling axis of the intermediate part and the swivelling axis of the system extend.

The present invention also relates to a beater comprising an intermediate part on which a part is mounted at which serves to support the beater head or a rod which bears the beater head. In this beater, the mechanism operated by the foot comprises a swivelling pedal and a linkage which extends between said pedal and said intermediate part. The intermediate part comprises a guide means which serves to support part of the linkage and which enables the linkage to wind or unwind on said guide means during the movement of the pedal. In particular, said linkage is a chain and said guide means is part of a ring gear. For example, the ring gear part can be disposed on the intermediate part so that the distance which separates the chain from the swivelling axis of the intermediate part is a minimum when the return means is in its inoperative position or when the head is separated from the drum.

According to another embodiment of the beater according to the invention, the first part or end of the return means is attached to an element which is capable of slipping, rolling or sliding a long a first wall which is comprised by a part which is attached to the intermediate part. The part which is attached to the intermediate part is advantageously a wheel having a groove along which said element is supported, said wheel being mounted on a moveable shaft borne by a body which is joined to the intermediate part. The intermediate part preferably bears a shaft, the axis of which is substantially parallel to the swivelling axis of the intermediate part, whilst the body is mounted on said shaft of the intermediate part.

According to one possible embodiment, said body is swivel-mounted on said shaft and has an inoperative position, whilst said intermediate part has a striker pin which, when the intermediate part swivels in the direction in which it approaches the head of the drum, bears on said body and pushes said body into a position remote from its inoperative position.

The invention relates also to a beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, a support, a shaft which is borne by said support and on which said element is mounted, and an intermediate part having a recess intended to receive at least part of a bearing mounted on the shaft so that said intermediate part can swivel about the shaft, said intermediate part being provided with a rod, whereby the return mechanism comprises a rolled spring blade with an inner end attached to the rod of the intermediate part and an outer end connected to the support by means of a connecting piece, said spring blade exerting a return force for moving the head away from the drum. The use of such a spring blade is advantageous, as the spring blade can be placed in a chamber, such as a substantially closed chamber, whereby protecting the spring blade and whereby preventing the possible soil thereof. When the chamber is substantially closed, the spring blade can be provided with oil(s), grease(s), lubricating means, anti corrosion means, etc. whereby ensuring substantially constant properties for the spring blade. It is obvious that instead of using one spring blade, it is possible to use two, three, or more spring blades, exerting a same return force or different return forces.

Advantageously, the connecting piece is adapted for controlling the return force of the spring blade.

For example, the connecting piece is mounted rotating with respect to an axis corresponding to the axis of rotation of the element bearing the head, and in which the beater comprises a system for maintaining the connecting piece in rotated positions with respect to the axis. Such a rotating connecting piece is advantageous, as by using marks or arrows on the connecting piece and on the support, it is possible to control and/or to select the desired return force.

Another beater of the invention is a beater for striking a drum, which comprises:

an element which is swivel-mounted in relation to an axis, said element bearing a head which is intended to strike the drum and which is connected to a mechanism operated by the foot in order to displace the head towards the drum and to a return mechanism for moving said head away from said drum, the element moving according to a swivel movement of the element from a substantially stable position up to a position where the head contacts the drum, a support, and a shaft which is borne by said support and on which said element is mounted, whereby the return mechanism comprises a first part attached to an intermediate body which is at least partly swivel-mounted in relation to the swivel axis of the element, and whereby the element and the intermediate body are in relation to each other so that the return mechanism does not act on the element for a first portion of the swivel movement thereof adjacent to the stable position, while acting on the element for at least a second portion of the swivel movement different from the first portion. Such a device is advantageous for enabling a quick or rapid initial movement of the mechanism operated by the foot for moving the element towards the drum.

According to an embodiment of this beater, the intermediate body is mounted rotating with respect to the axis of the element, and in which the element comprises an abutment intended to contact a part of the intermediate body for said second portion of the swivel movement, while not contacting said part of the intermediate body during the first portion of the swivel movement. Advantageously, the beater is further provided with a mechanism suitable for adapting the relative position between the abutment and the part of the intermediate body so as to define the first portion of the swivel movement.

Still a further beater of the invention is a beater for striking a drum, which comprises:

an element which is swivel-mounted in relation to an axis, said element bearing a head which is intended to strike the drum and which is connected to a mechanism operated by the foot in order to displace the head towards the drum and to a return mechanism for moving said head away from said drum, said return mechanism having a first part and a second part associated to each other, a support with a supporting shaft, a hollow extending in the support as well as in the supporting shaft between two open ends, and an intermediate part having a recess intended to receive at least part of a bearing mounted on the hollow rod of the support and having a rod extending through the hollow shaft and the hollow of the support, said rod having a free end extending outside of the hollow of the support, whereby said element is mounted on said intermediate part, and whereby the return mechanism is designed in order to exert a return force on an component selected from the rod and pieces attached to said rod.

A further embodiment of a beater of the invention comprises:

an element which is swivel-mounted in relation to an axis, said element bearing a head which is intended to strike the drum and which is connected to a mechanism operated by the foot in order to displace the head towards the drum and to a return mechanism for moving said head away from said drum, said return mechanism having a first part and a second part associated to each other, a support, and a shaft which is borne by said support and on which said element is mounted, whereby the return mechanism is designed in order to exert a return force between a component connected to the element and piece connected to the support, whereby said component comprises a means of fixation for the first part of the return mechanism, said means of fixation of said first part being designed in order to fix said first part at a point which is distant from the axis of the element, while the piece to which the second part of the return mechanism is attached is swivel-mounted with respect to said support.

The invention relates also to a beater provided with a return mechanism comprising a rolled spring blade.

It is obvious that a beater of the invention can be associated to one or more beaters not of the invention and/or of the invention, so as to form a beater assembly with at least two heads for striking one single drum and/or different drums. The beaters of one assembly have advantageously at least one different characteristic, said characteristic being for example type of head, length of the arm bearing the head, return force, return mechanism, initial movement substantially free of resistance, etc. Preferably two or more beaters of the invention are associated or combined.

It is also possible to use one single return mechanism for moving back two mechanisms activated by a foot.

The invention also relates to a method of playing pieces of music by means of a drum and one beater according to the invention.

Particular features and details of the invention follow from the detailed description given below, in which reference is made to the accompanying drawings.

DESCRIPTION OF PREFERRED EMBODIMENTS

Figure 1:
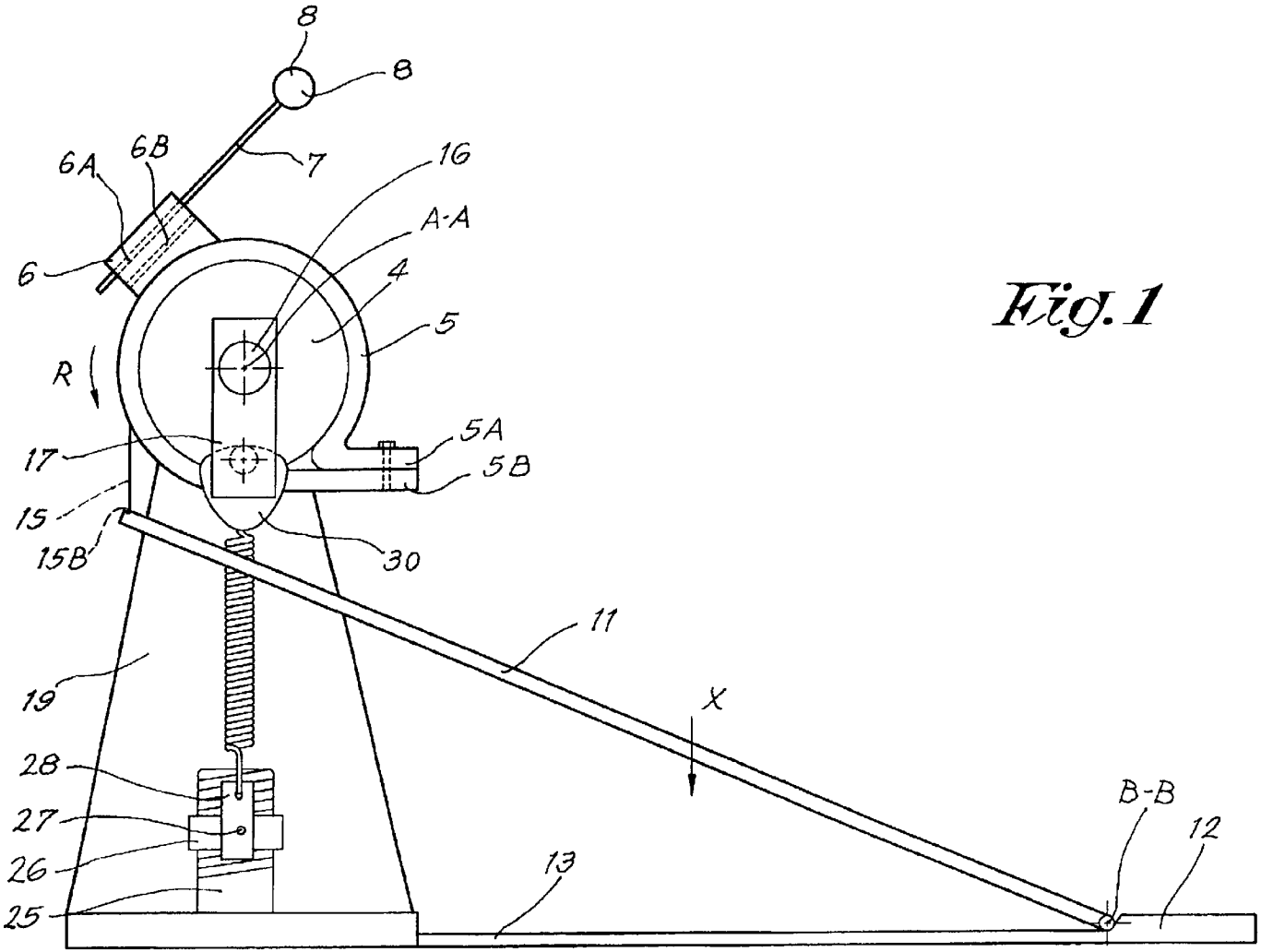
FIG. 1 is a side view of a beater according to the invention.

The beater 1 which is illustrated by way of example uniquely comprises:

- a fixed shaft 2 (axis A—A—mounted on a support 19) on which an intermediate part 4 is mounted with the interposition of a bearing 3 or double bearing;
- a support element 5 mounted on the intermediate part 4 and clamped to said part 4 by means of clamping means 10 which clamp lugs 5A, 5B against each other, said support element comprising a protuberance 6 with two parallel channels 6A, 6B (perpendicular to axis A—A), said channels being intended to provide a passage for a rod 7 which at its free end bears a head 8 which is intended to strike a the skin of a drum, a clamping means 9 ensuring the fixation of the rod in a channel;
- a pedal 11 which is swivel-mounted (axis B—B) in relation to the heel piece 12 of the support 19, said heel piece being joined by rods 13 to the support 19;

part of a ring gear 14 fixed to the intermediate part 4;

- a linkage such as a chain 15, one end 15A of which is attached to the intermediate part or to the gear 14 and the other end 15B of which is attached to the pedal 11, part 15C of said chain being wound on said ring gear part 14;
- a shaft 16 borne by the intermediate part and having an axis corresponding to axis A—A of shaft 2;
- a body 17 mounted on shaft 16, said body being fixed to said shaft by means of a clamping means 18, said body comprising two lugs 20, 21 between which a rod 22 extends which bears a wheel 23 which has an annular groove 24;
- a rod 25 which is at least partly threaded and which is mounted on the support 19;
- a threaded ring 26 screwed to the rod 25, said ring bearing a rod 27 which serves as a pivot for a bar 28;
- a return means (such as a spring) which extends between the bar 28 and a hook 30, the upper part of which fits into the groove 24 in the wheel 23 so that said wheel is capable of sliding or rolling in relation to said upper part of the hook.

The tension of the return means can be regulated by adjusting the position of the collar 26 on the rod 25.

During a downward movement (X) of the pedal 11 (when it is pushed by a foot), the chain exerts a tensile force and a torque on the intermediate part 4 which is converted into a rotation of the intermediate part and therefore into an approach movement of the head 8 towards the drum. The rotating movement is executed against the force exerted by the spring 29. At the start of the rotating movement, the chain exerts a force on the intermediate part 4 with a first lever arm b1, whilst at the end of the movement the chain exerts a force on the intermediate part 4 with a second lever arm b2 which is longer than b1. Thus the rotating movement is rapid at the start of the movement, whilst the striking force of the head is a maximum at the end of the movement. When the foot is raised again, the spring 29 acts on the intermediate part in order to ensure that the chain is wound on the ring gear and the pedal is raised again.

Figure 5A:
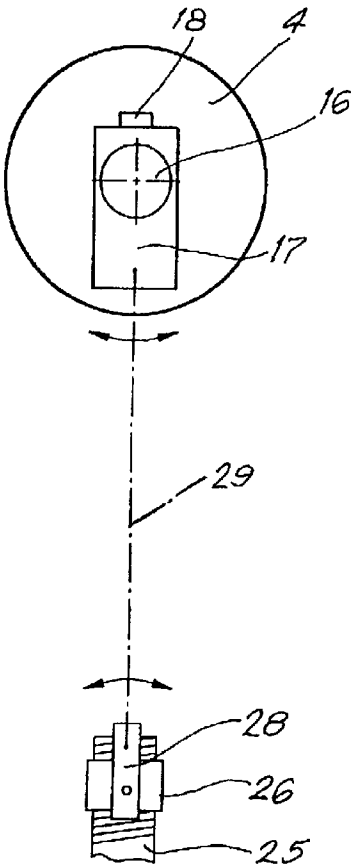
FIGS. 5A and 5B are schematic illustrations of possible movements of the intermediate part and of the spring.
Figure 5B:
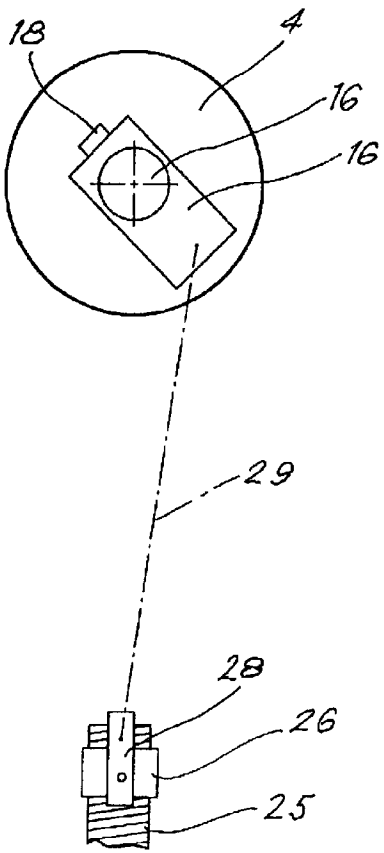

In the inoperative position of the beater, the spring 29 exerts a force which extends between the pivots 22 and 27 (FIG. 5A). During the rotation X of the pedal and of the intermediate part, the spring 29 exerts a force which passes through the axis of the pivot 27 but which does not pass through the swivelling axis A—A, so that the spring exerts a restoring torque on the intermediate part 4. When the intermediate part returns to its starting position, the bar 28 executes a certain number of vibrations or slight to-and-fro movements, said vibrations or movements ensuring a good damping effect. In its inoperative position, the spring 29 exerts a force within the plane which passes through or which is defined by the swivelling axes of the intermediate part 4 and of the bar 28. In its return position, the spring 29 (shown by the broken lines) exerts a force along a line which intersects the swivelling axis of the bar 28 but which is inclined in relation to the plane which passes through or which is defined by the swivelling axes of the intermediate part 4 and of the bar 28. (FIG. 5B)

Figure 6A:
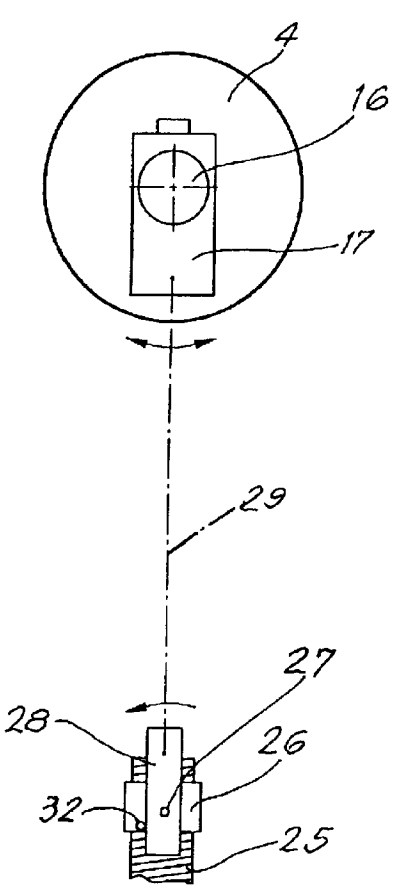
FIGS. 6A and 6B are schematic illustrations of possible movements of the intermediate part and of the spring in a variant of the invention.
Figure 6B:
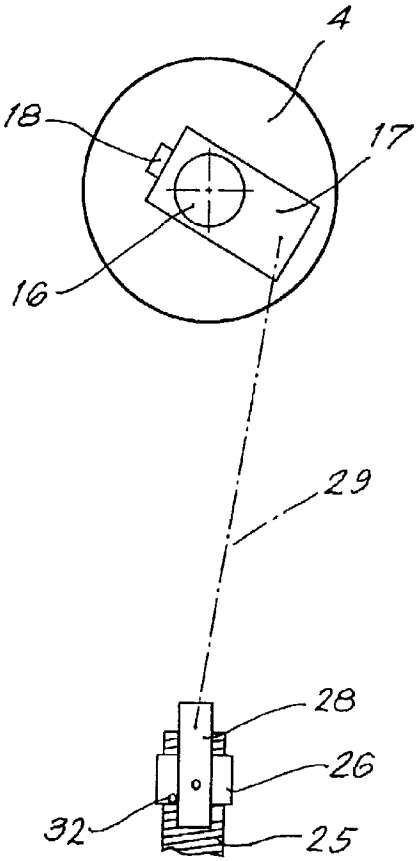

In FIG. 6A, the collar or ring 26 bears a stop 32 which is intended to limit or even to prevent the swivelling of the bar 28, for example when the pedal moves so that the head 8 approaches the drum. In its inoperative position, the spring 29 exerts a force in the plane which passes though or which is defined by the swivelling axes of the intermediate part 4 or of the bar 28. In its return position, the spring 29 (shown by the broken lines) exerts a force along a line which is remote from the swivelling axis of the bar 28 and which is inclined in relation to the plane which passes through or which is defined by the swivelling axes of the intermediate part 4 and of the bar 28 (FIG. 6B).

Figure 7A:
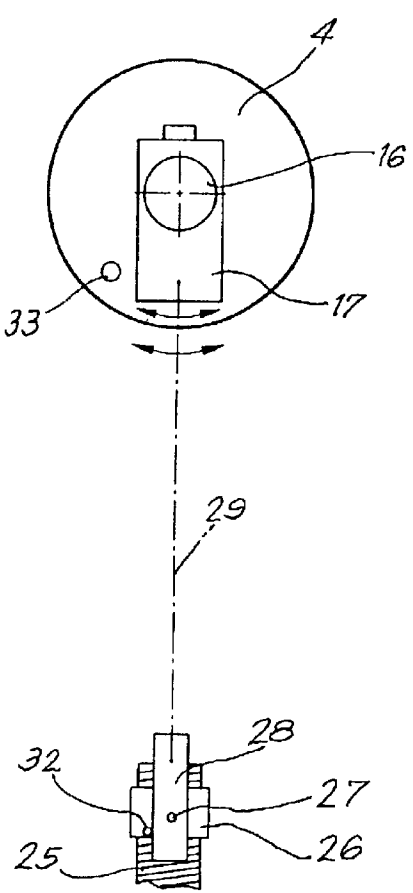
FIGS. 7A and 7B are views similar to that of FIGS. 6A and 6B, for another variant.
Figure 7B:
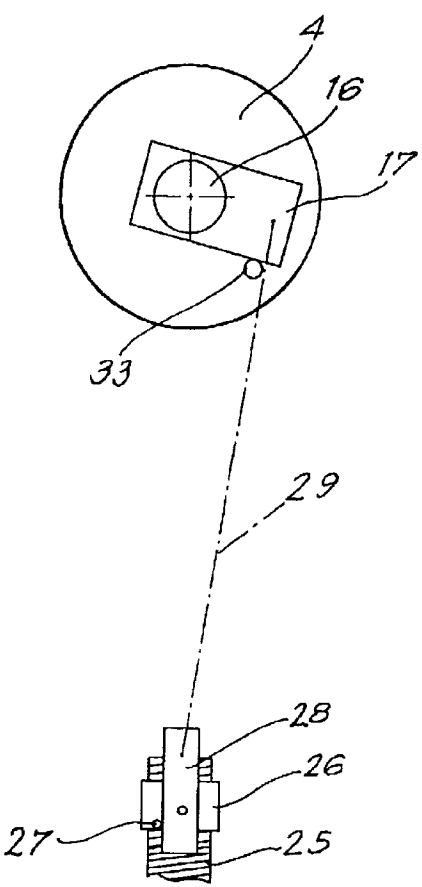

In FIG. 7A, the collar or ring 26 bears stops 32 which are intended to limit or even to prevent the swivelling of the bar 28, for example when the pedal moves so that the head 8 approaches the drum. Moreover, the body 17 is swivel-mounted on the shaft 16, with the interposition of a bearing, for example, whilst the intermediate part 4 bears a striker pin 33 which, during the approach movement of the head towards the drum, pushes the body 17 so that it tensions the spring and so that a restoring torque is exerted on the return part (FIG. 7B). When the pressure of the foot on the pedal is released, the body 17 exerts a force on the striker pin 33 in order to return part 4 into its starting position. On this release of pressure, the body 4 may execute slight movements which are out of step with the movement of the body, which enables enhanced damping of the spring force to be achieved.

In one embodiment, which is not illustrated, the stop 32 is placed or disposed so that in the inoperative position the spring exerts a force along a line which is remote from the swivelling axis of the bar 28. This then enables a minimum torque always to be exerted by the spring on the bar in order to return the latter into its position in which it touches the stop.

It is clear that, instead of being borne by the ring, the stop could also be borne by the bar 28 or by a part which is integral with the support (19).

Figure 2:
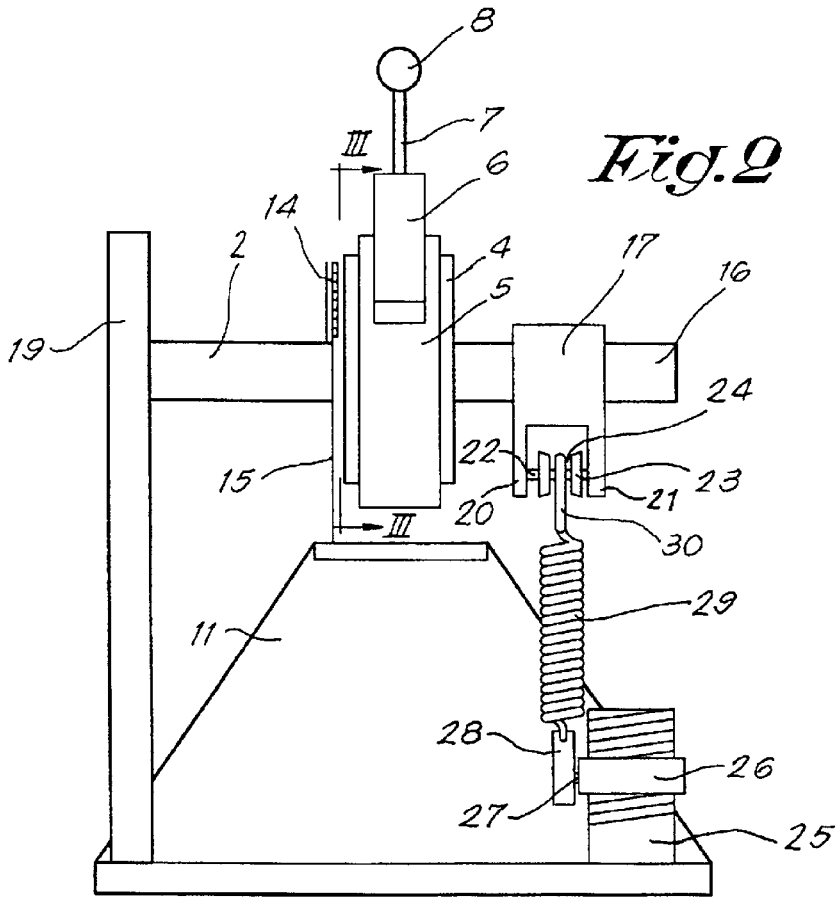
FIG. 2 is a front view of the beater according to the invention as shown in FIG. 1.
Figure 3:
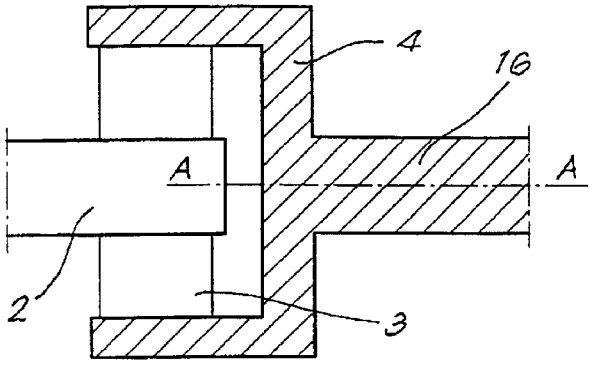
FIG. 3 is a partial section (line III—III) through the beater shown in FIG. 2.
Figure 4:
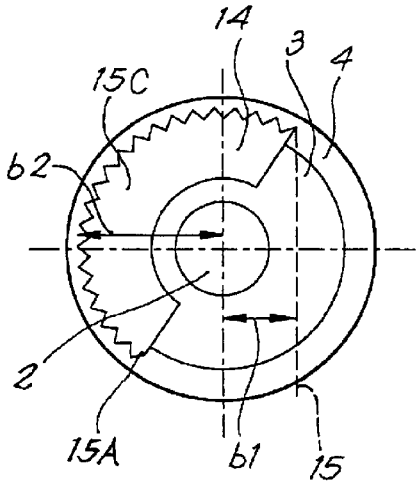
FIG. 4 is a section through a detail of the beater of FIG. 1.

The beater as illustrated in FIGS. 1 and 2, optionally with the variants shown in FIGS. 6 and 7, enables particular pieces of music to be played, said pieces being distinguished in particular, for example, by rhythms comprising rapid beats.

The invention thus relates to: a beater which is characterised by a shaft which may or may not be fixed, but which is preferably fixed, on which an intermediate part 4 is mounted via at least one bearing, on which intermediate part a support element is placed or fixed which bears the beater head or the rod provided with the beater head (the latter, for example, enables the placement of the head or the inclination of the rod provided with the beater head to be adjusted); a beater, the support element of which comprises means for adapting the spacing of the rod 7 which is provided with the head 8 to be adapted in relation to the axis of rotation A—A; a beater, the return means of which is attached to an element which swivels in relation to the support for the beater or the swivelling of which can be controlled; a beater, the return means of which extends between two elements which swivel in relation to the support, and to a method of creating sounds or a melody using a beater according to the invention.

It is clear that numerous modifications can be made without departing from the scope of the invention; thus it would be possible to use a cord or a strap which is optionally partially elastic instead of the chain, to use an intermediate part bearing a shaft which is off-centre with respect to the axis A—A and on which the wheel 23 s also mounted, to use a single mounting to which the shaft 2 is attached, optionally and advantageously with the interposition of a bearing, etc.

Figure 8:
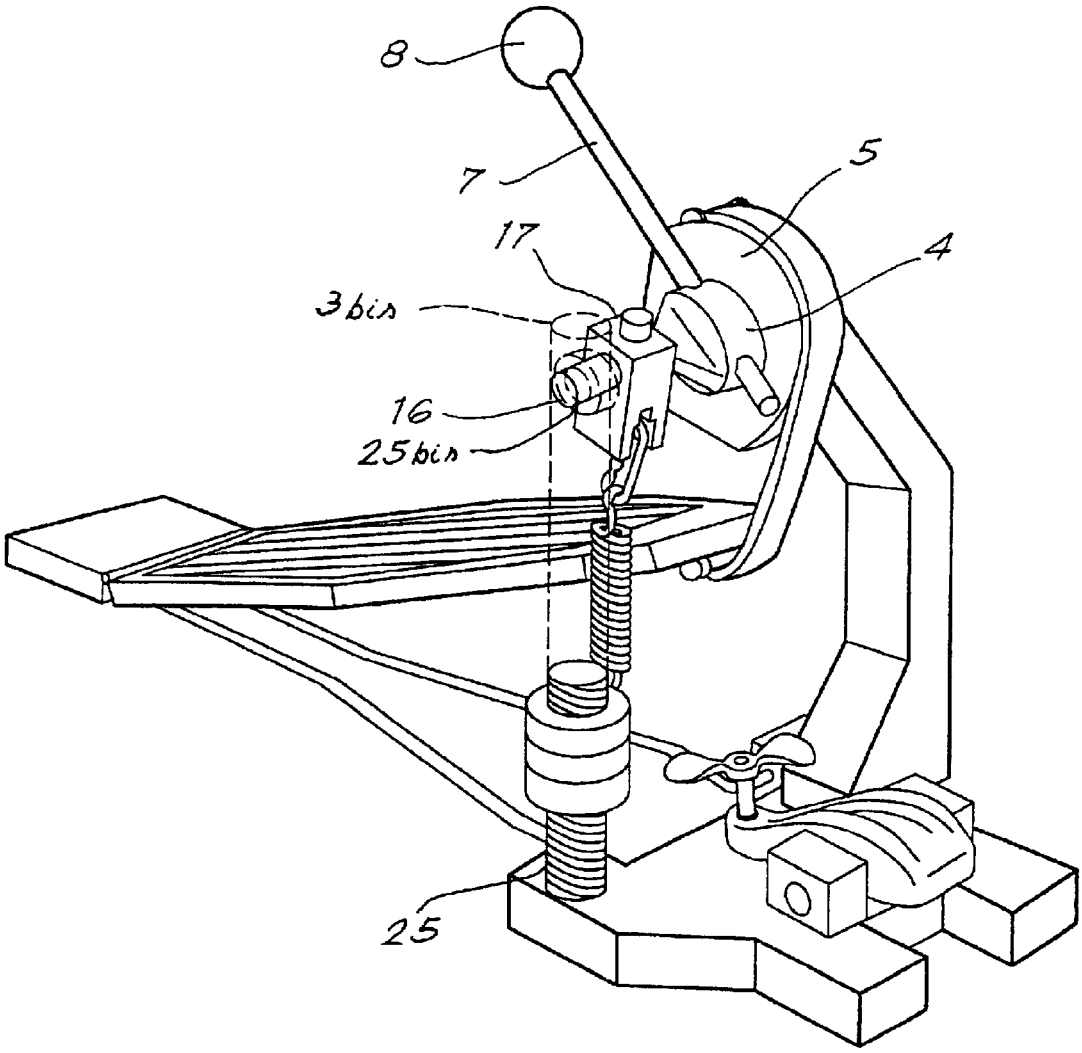
FIG. 8 is a perspective view of a specific embodiment of a beater of the invention.
Figure 9:
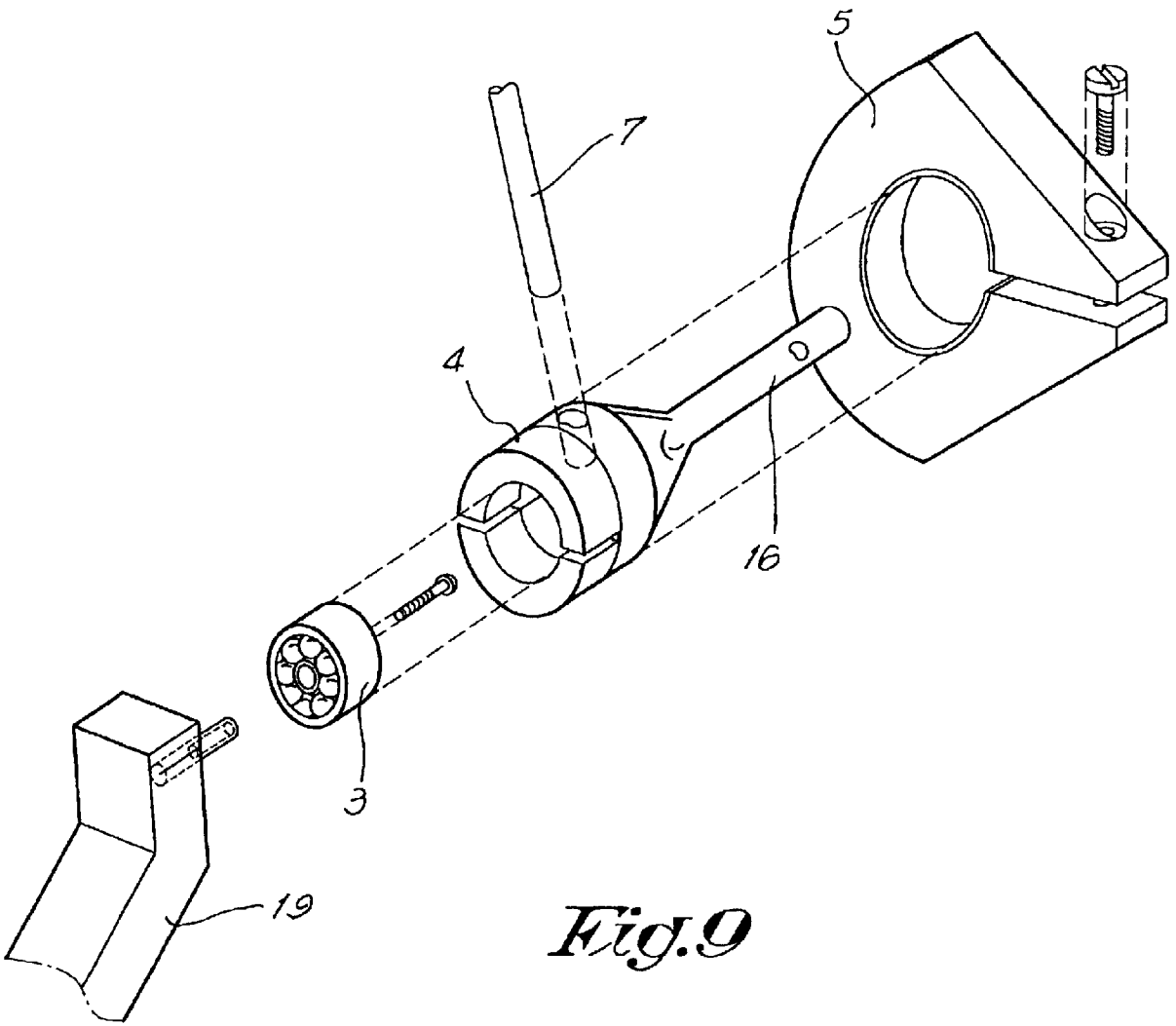
FIG. 9 is an exploded view of a detail of the embodiment of FIG. 8.

FIGS. 8 and 9 are a perspective view of one form of the invention and an exploded view of a detail of this embodiment, respectively.

In this embodiment, the shaft 16 is also borne by a support bearing 25. Said shaft is mounted so that it can rotate on a support 25*b* is (shown in dashed lines) by virtue of the bearing 3*b* is (shown in dashed lines). This embodiment has the advantage of ensuring that the shaft 16 is maintained along a predetermined axis, along a horizontal axis, for example.

Figure 10:
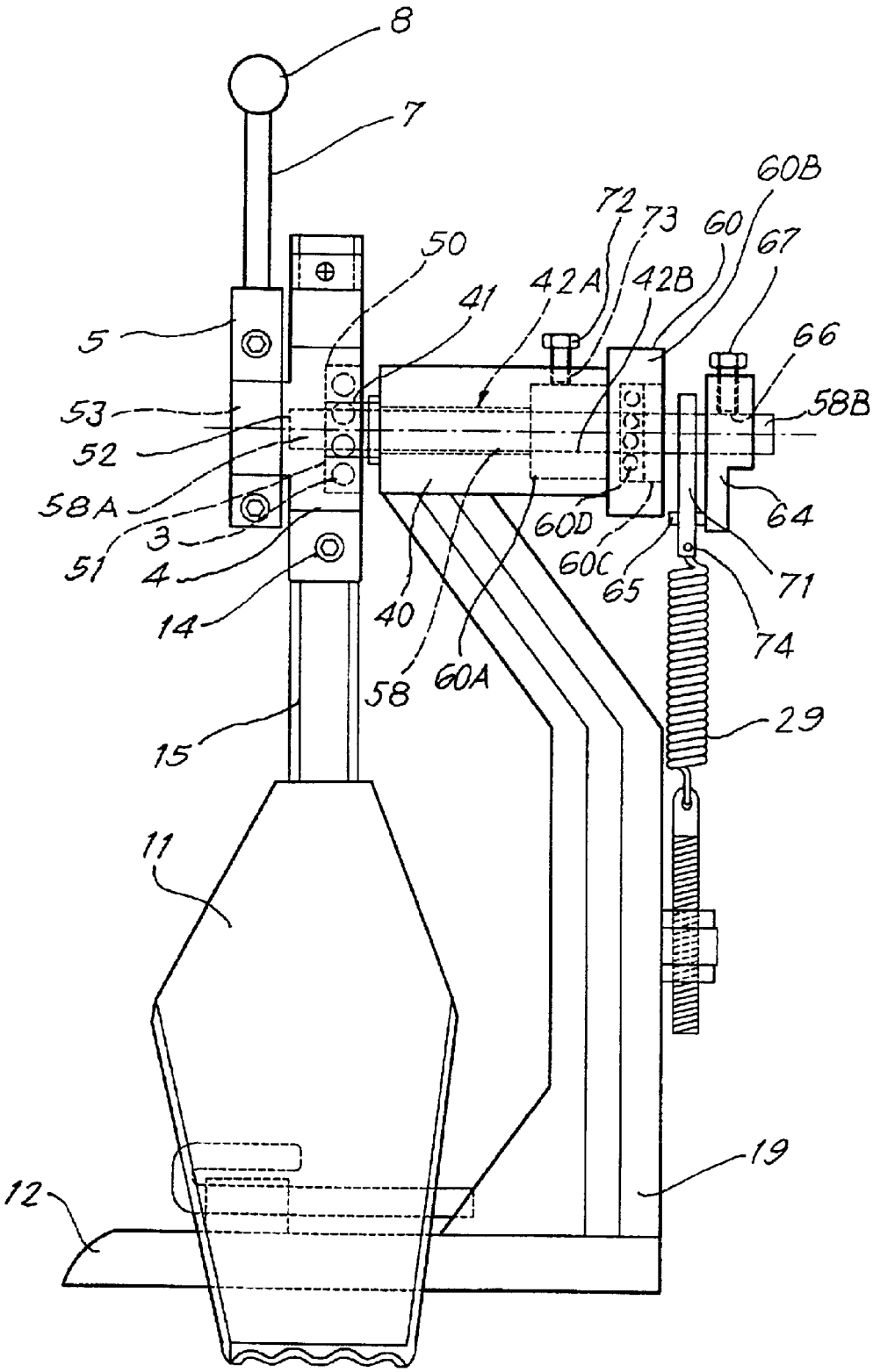
FIG. 10 is a front view of a further beater of the invention.

FIG. 10 shows another beater of the invention. The beater 1 of FIG. 10 is similar to the beater of FIG. 1, but is provided with some specific details.

The support 19 is provided with a supporting member 40 having a cylindrical protruding part 41. The supporting member 40 has a hollow 42 extending from the free end of the cylindrical protruding part up to an end of the member 40. Said hollow 42 comprises a first cylindrical chamber 42A connected to a second cylindrical chamber 42B, the latter having an inner diameter greater than the inner diameter of the first chamber 42A.

An intermediate part 4 is provided with a recess 50 constituted by a first larger portion 51 adjacent to a lateral face of the element 4, and a portion 52 with a smaller cross section, said portion extending in a direction opposite to the face adjacent to the first portion of the recess. A bearing 3 is placed in the recess portion 51, said bearing having a central passage adapted for contacting the outer surface of the protruding part 41, whereby the intermediate part 4 is mounted rotating with respect to the support.

The intermediate part is provided with a protruding cylindrical part 53 on which a support element 5 bearing the head 8 is clamped. The clamping system enables to position the support element 5 and thus the head 8 as desired with respect to the support 19.

The intermediate part is associated to a rod 58, one end 58A of which is engaged in the recess portion 52 in which said end is fixed so as to avoid relative rotation movement between the rod 58 and the intermediate part 4 (for example the end 58A has a hexagonal cross section corresponding to the hexagonal cross section of the recess portion 52), while the other end 58B extends outside the support element 40. The rod extends through the hollow passages of the support element 40.

The pedal 11 which is swivel-mounted or pivotable with respect to a heel piece 12 of the support 19 is connected to the intermediate part by the linkage band 15 which can be partly wound on a ring element 14 attached on the outer cylindrical face of the intermediate part 4.

A cover body 60 closes at least partly the open end of the chamber 42B. Said body 60 has a portion 60A adapted for being engaged in the chamber 42A and adapted for being rotating with respect to the support element 40 (i.e. so as to be able to adapt the relative position of the cover with respect to the support 40), and a portion 60B with a diameter larger than the inner diameter of the recess portion 42A. The cover body is provided with a central passage 61 ending by a chamber 62 suitable for receiving a bearing 63, said bearing 63 supporting a portion of the rod 58.

The rod 58 bears a leg 64 provided with a pin or arm 65. The leg 64 is fixedly attached on said rod 58, so that a rotation of the rod 58 causes a rotation of the leg 64.

For maintaining the position of the cover, a screw 72 can be used, said screw 72 being screwed in a threaded hollow 73 of the support 40.

Between the leg 64 and the cover 60, a plate 71 is placed, said plate having a hollow through which the rod 58 extends and a connecting element 74 for attaching an end of the spring 29.

The plate 71 acting as intermediate body is connected to the rod 58, so that the rod 58 can freely rotate with respect to the plate 71 or so that the plate can swivel with respect to the swivel axis A—A of the element 4 or head 8.

Figure 11:
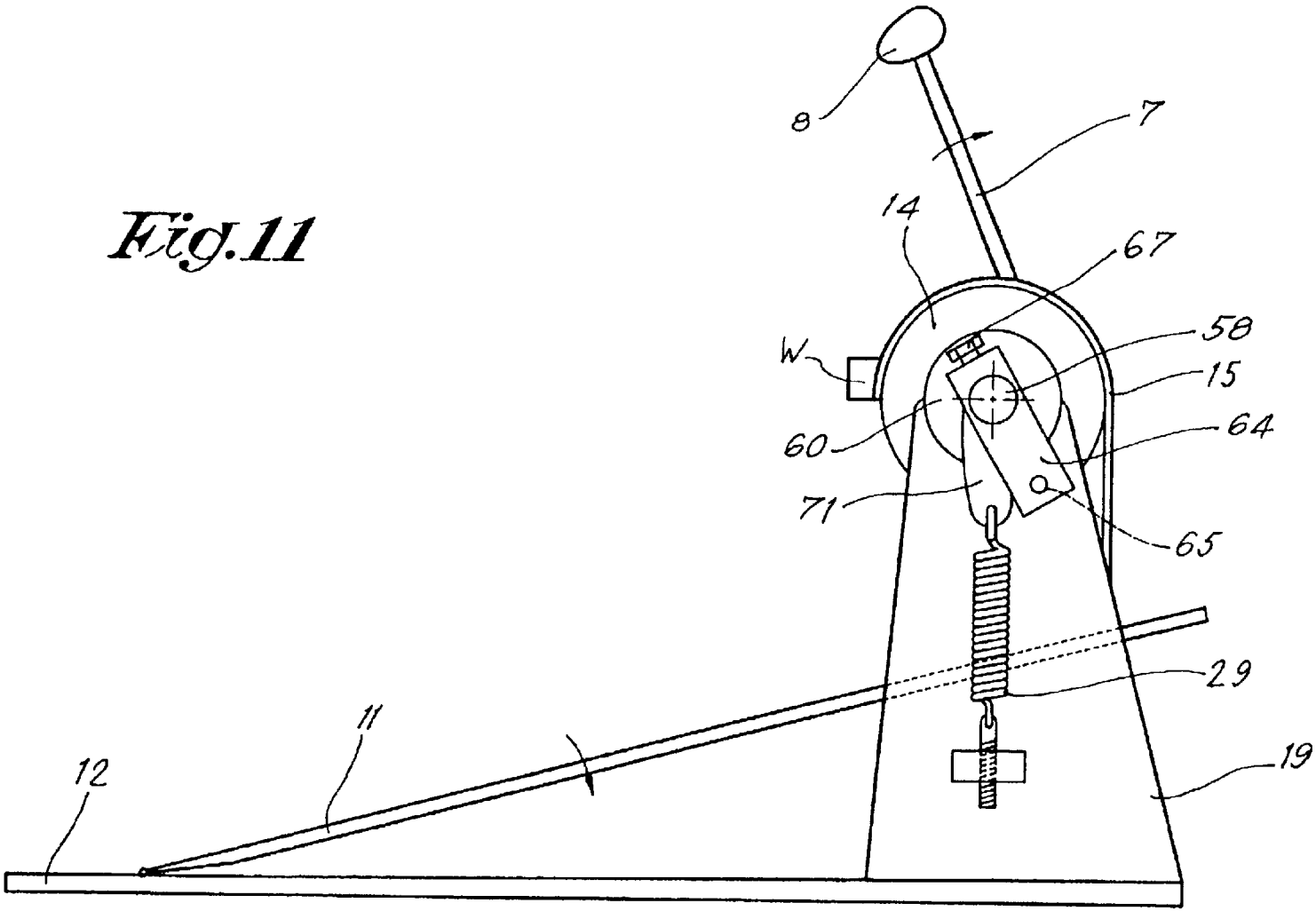
FIG. 11 is a lateral view of the beater of FIG. 10.
Figure 12:
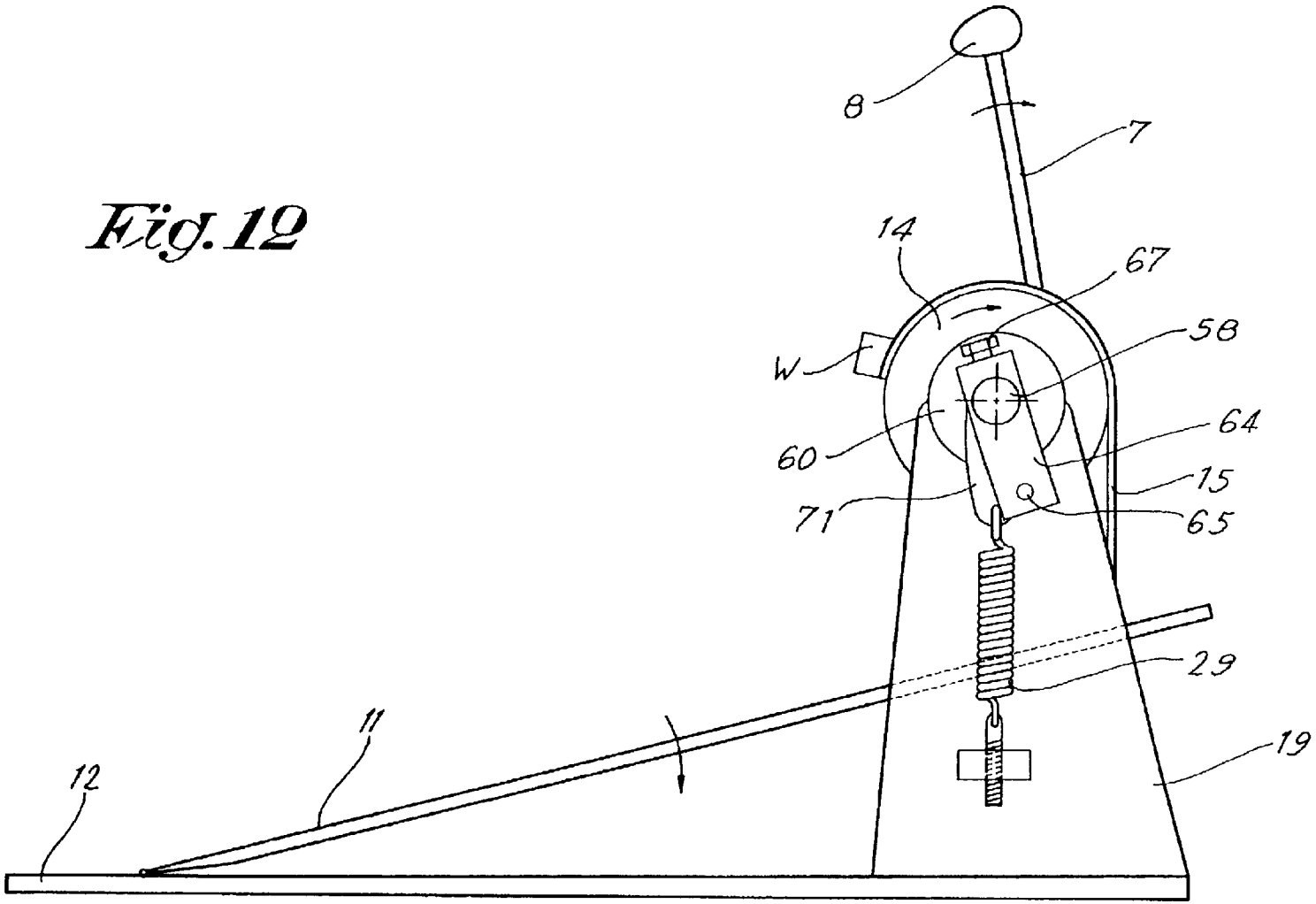
FIGS. 12 and 13 are views similar to the view of FIG. 11 showing the movement of the head.
Figure 13:
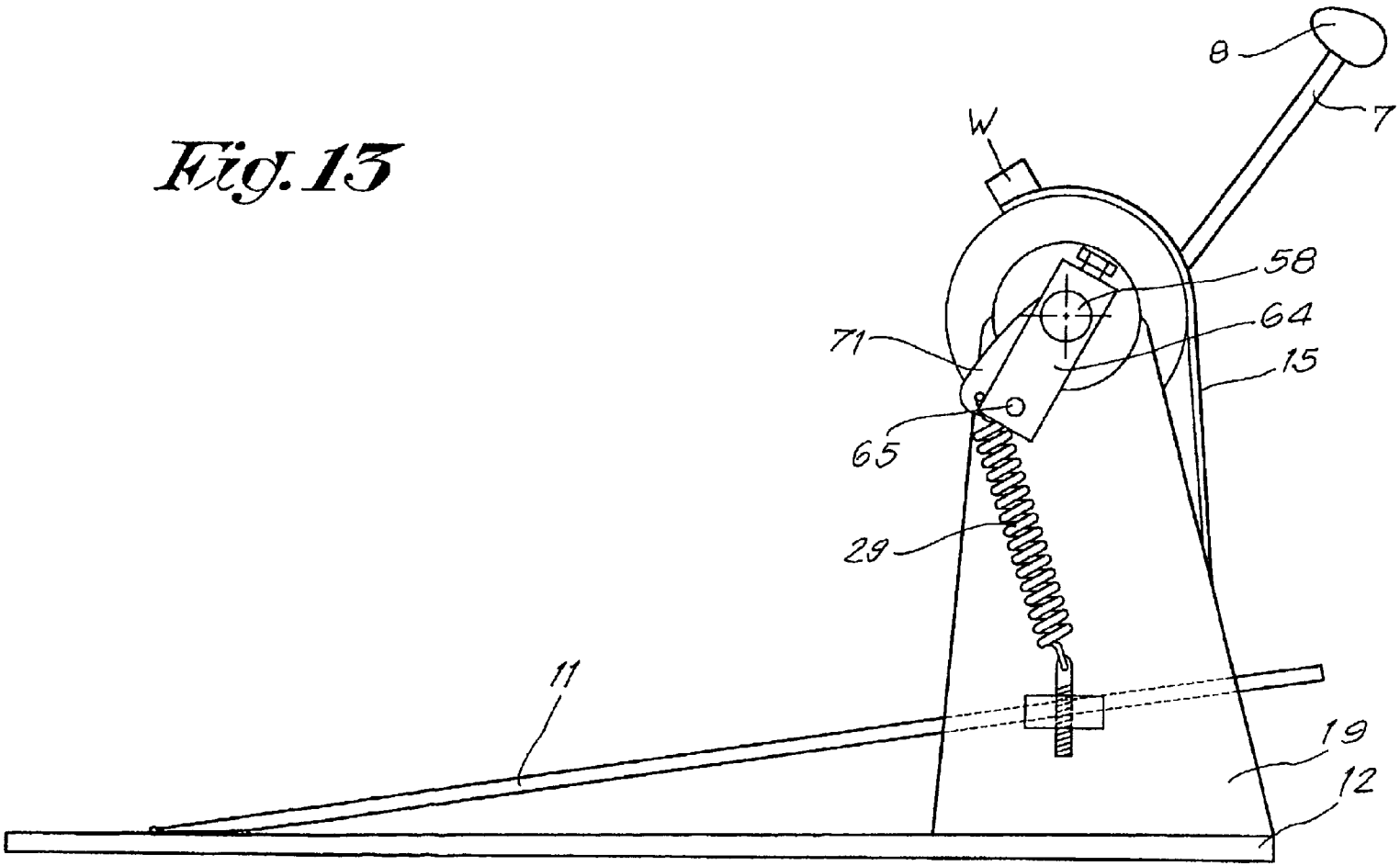

When the rod 58 is rotated, the leg 64 and the pin 65 are moved so that the pin 65 is moved towards the plate 71. As long as the arm or pin 65 does not contact the plate 71, the rotation of the rod and thus of the head 8 is not made against the action or force of the spring 29. When the arm 65 contacts the plate 71, the further rotation of the rod will cause a rotation of the plate 71 and therefore a stretching of the spring 29. (FIGS. 13 and 14) The spring 29 is advantageously already in stretched condition before the plate 71 is contacted by the arm 65 so as to exert directly a return force on the legs when the plate contacts the arm 65. The initial force required for moving the head towards the drum is thus low, as the initial movement (I) is not made against the action of the spring (see FIG. 11). In the position of FIG. 11, the arm 65 does not contact the plate 71. In order to maintain this position, a weight W can be placed on the part 4 so as to counterbalance the rotation couple due to the weight of the pedal 11 and of the leg 64. Other means can be used for counterbalancing this rotation couple, such as weight place on the rod 7, for example in the vicinity of the head 8.

For attaching the leg 64 and for defining the position of the leg with respect to the rod 58, the leg 64 is provided with an opening 66 in which the rod is engaged and which has a cross section enabling a rotation of the leg with respect to the rod, and with a screw 67 screwed in a hollow of the leg so that an end of the screw contacts the rod 58 and blocks the position of the leg with respect to the rod.

If desired, it is possible to use two parallel legs with a pin extending there between. This embodiment is advantageous so as to limit possible movement of the plate along the rod 58.

Figure 14:
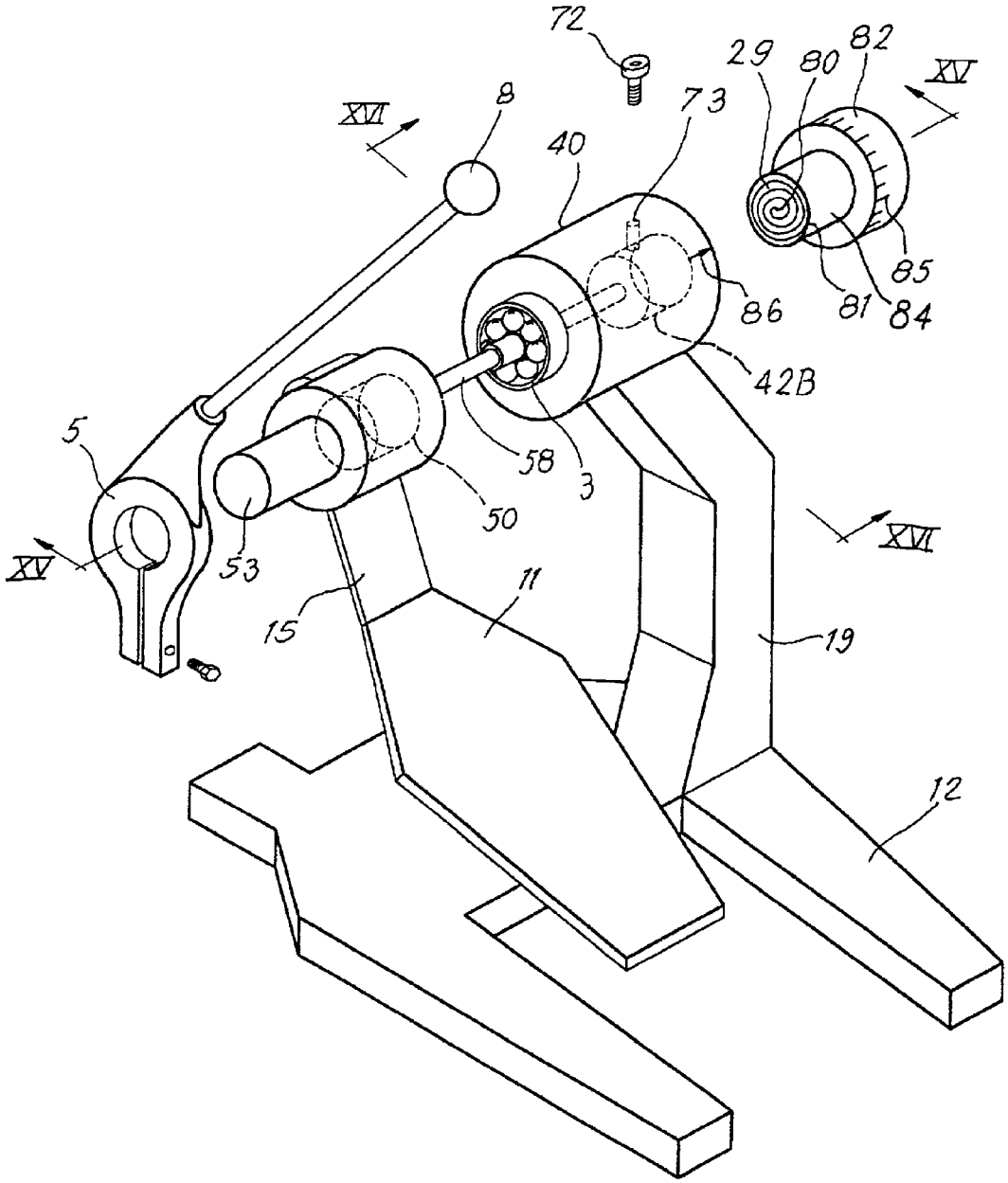
FIG. 14 is an exploded perspective view of a further embodiment of the invention.
Figure 15:
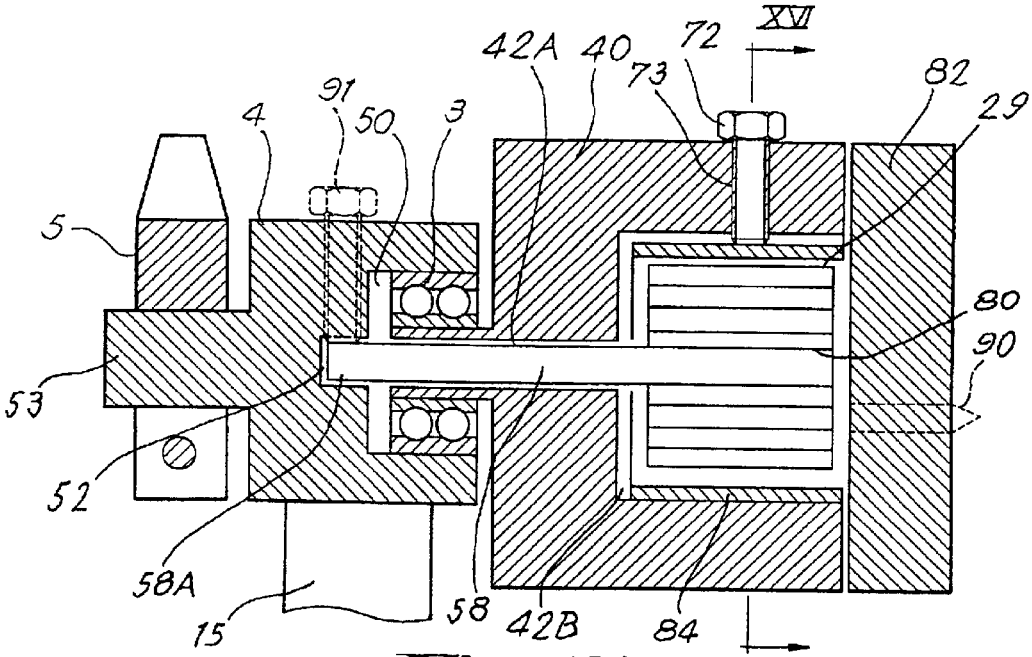
FIGS. 15 and 16 are cross section views along the line XV—XV and XVI—XVI of the embodiment of FIG. 14.
Figure 16:
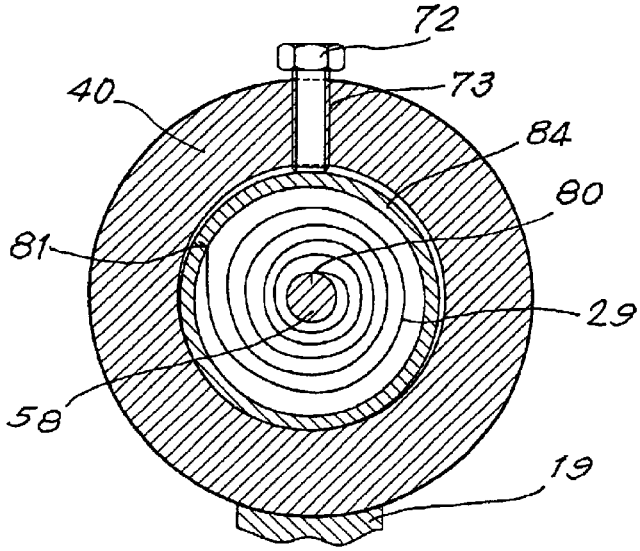

The beater of FIG. 14 is similar to the beater of FIG. 10, except that another return means 29 is used. The return means is a spring blade which is rolled. The inner end 80 of the spring blade is attached to the rod 58, while the outer end 81 is attached to a circular button 82, which can be moved with respect to the support 40 so as to control or adapt the return force exerted by the spring blade 29. A means such as a screw 72 can be used for maintaining in position the control button 82. Such a screw 72 is screwed in the hollow 73 so that the end of the screw 72 acts on the sleeve 84. The control button is provided with a hollow cylindrical sleeve 84 forming an envelope for receiving the rolled spring blade 29. Said hollow sleeve forms a chamber which can be filled with a lubricant. The support 40 is provided with a recess 42A with a surface in close contact with the outer surface of the sleeve 84. In order to facilitate the control of the return force, the button is provided with signs or FIG. 85 corresponding each to a determined return force, when said sign or figure is placed in regard to an arrow or line 86 of the support 40.

The button 82 is advantageously provided with a system 90 (shown in dashed lines) for filling the chamber of the sleeve 84 with lubricant (oils, synthetic, liquid, powder, etc.), so as to ensure the presence of sufficient lubricant for a correct working of the spring blade 29.

According to an advantageous detail of a possible embodiment, the rod 58, the spring blade 29 and the button 82 form an assembly. The rod 58 is first engaged in the hollow 42A and the engaged in the recess 52 of the part 4. A screw 91 shown in dashed lines is suitable for fixing the end 58A of the rod with the element 4. Other possible means could be to use a rod 58 with an end 58A with a cross section adapted to the cross section of the recess 52, such cross section being for example triangular, square, pentagonal, hexagonal. After engagement and fixation of the rod (end 58A) with the part 4, the button can be rotated so as to adapt the return force of the spring blade 29. When the requested return force is obtained, the screw 72 is adapted for maintaining the sleeve 84 in position.

Such a system using assembly comprising spring blade associated to a rod is advantageous as it enables an easy removal or replacement of one assembly by another, for example in case a spring blade is defect or in case the required return force is different. For example, the beater can be associated with an assembly with a low return force, an assembly with a medium return force or an assembly with a high return force.

Figure 17:
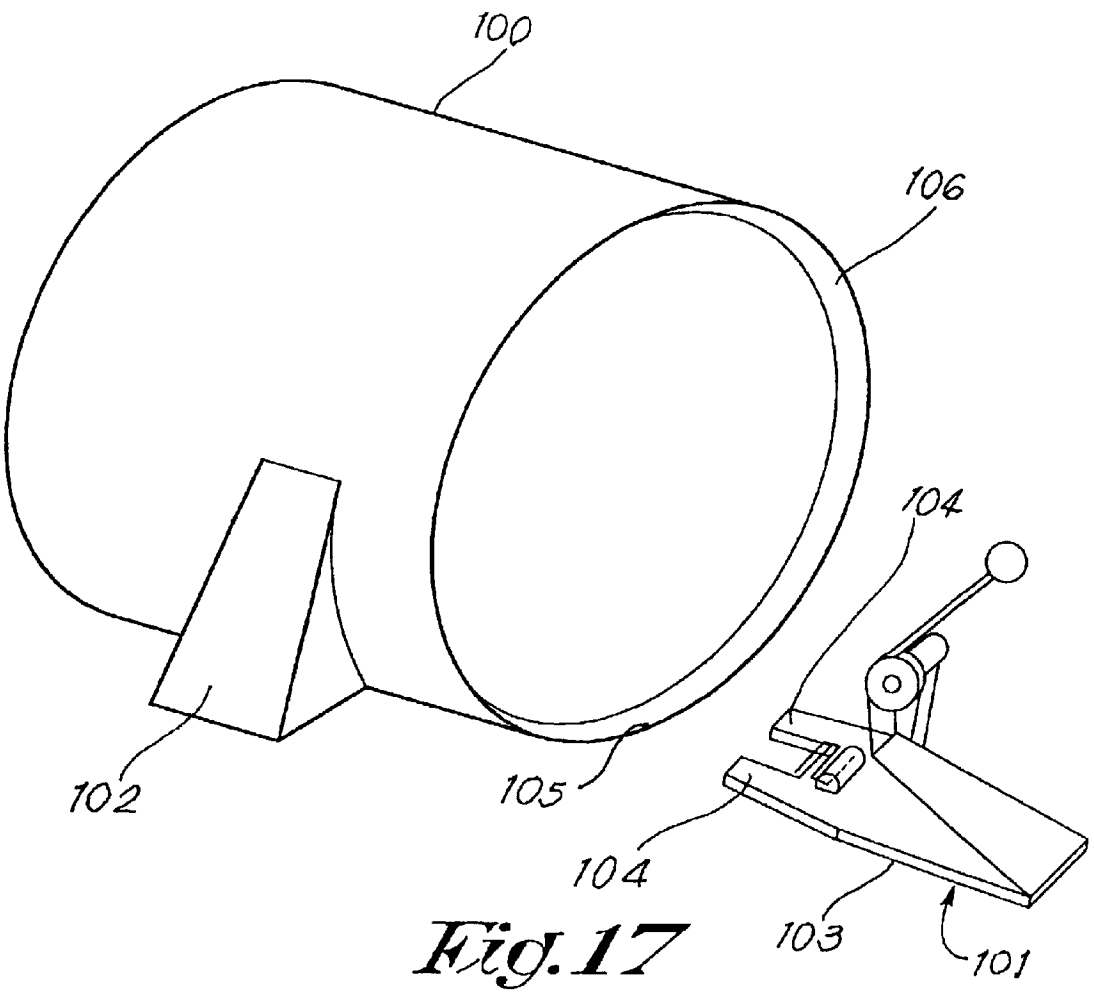
FIG. 17 is a schematic perspective view of a beater intended to be connected to a drum by a connecting system.

Beater of the invention can be connected or fixed to a drum 100. In FIG. 17, a beater 101 is represented, said beater being intended to be attached to the drum 100. The drum 100 is provided with two legs 102 so as to stabilize the drum 100. The beater 101 is provided with a bottom 103 with two substantially parallel arms 104, intended to be placed partly under the drum 100, one on the left side with respect to the lowest point 105 of the drum, the other on the right side with respect to the lowest point 105 of the drum 100.

Figure 18:
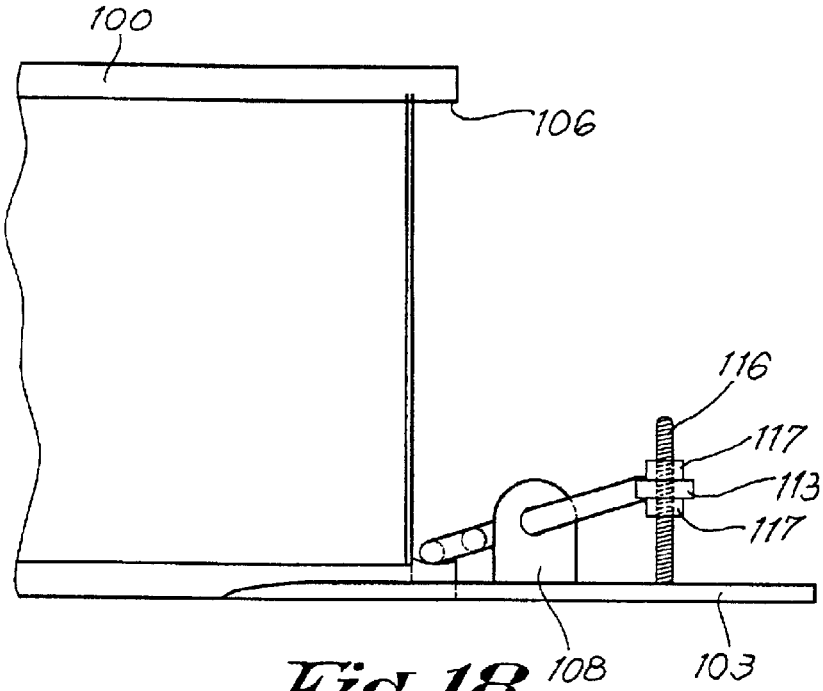
FIG. 18 is a lateral view of a portion of the beater connected to a drum.
Figure 19:
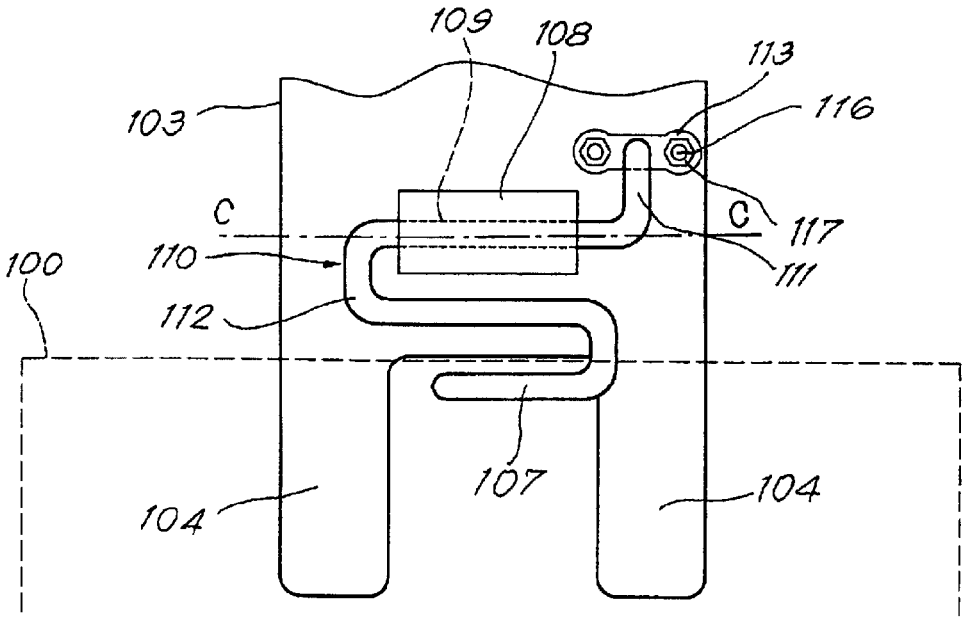
FIG. 19 is an upper view of the connecting system.
Figure 20:
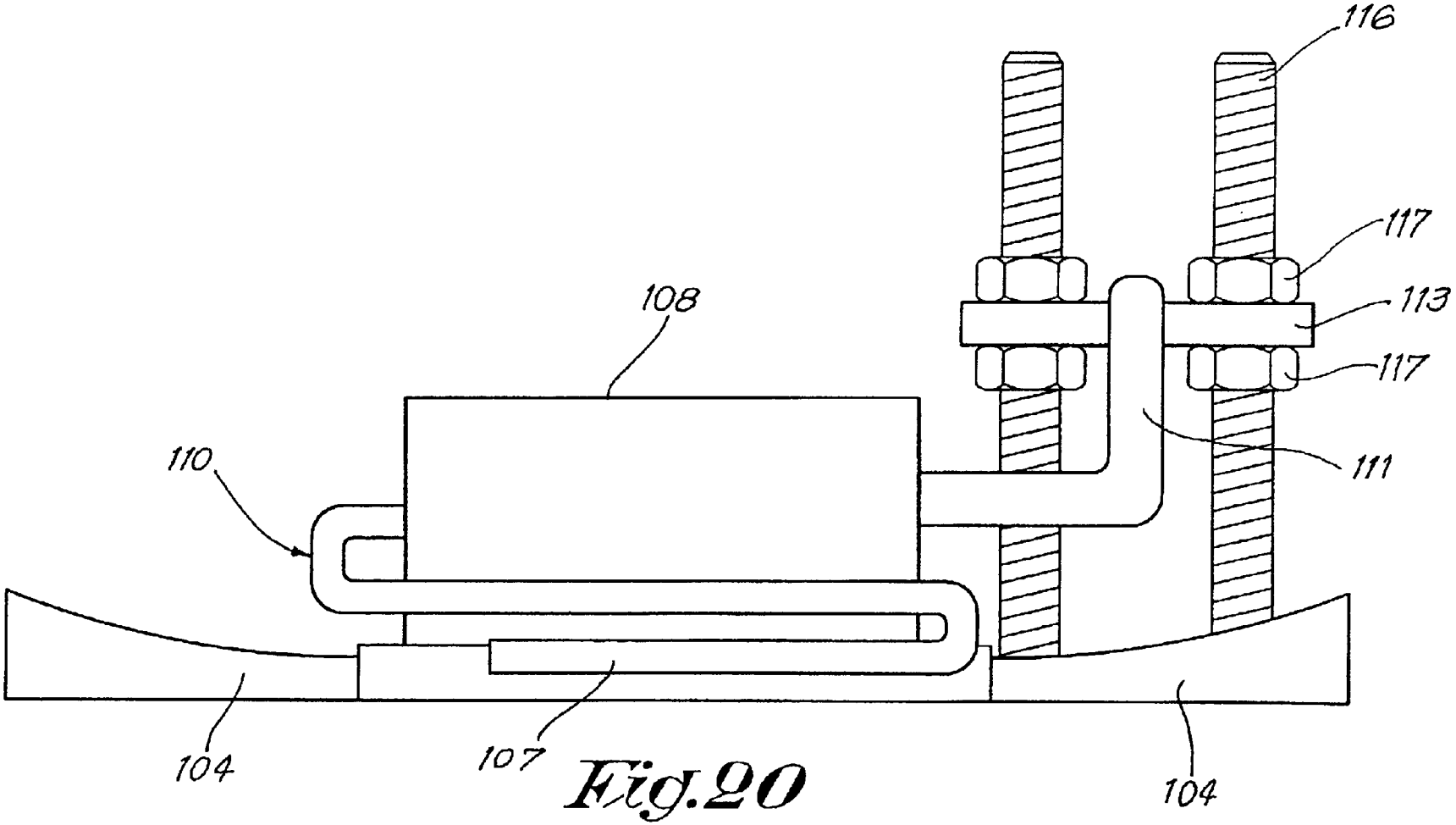
FIG. 20 is a front view of the connecting system.

A connecting system is disclosed in FIGS. 18 to 20, said connecting system 105 is suitable for connecting a beater, especially a beater of the invention, with a drum 100. The connecting system is intended to clamp a ring shaped skirt 106 of the drum 100 between, on the one hand, the two arms 104 of the bottom part of the beater and a clamping rod 107. The bottom part 103 is provided with a body 108 with a horizontal passage 109 for supporting a portion of a rod 110 and for enabling a rotation of the rod 110 with respect to the axis C—C of the passage 109. The rod 110 has a portion 111 extending outside the body 108 and acting as an operating arm for controlling the pivoting (around the axis C—C) of the rod 110. The rod 110 has also another portion 112 extending outside the body, said portion ending with the clamping rod 107.

A control system 115 is used for adapting and maintaining the position of the arm 111. Such a control system is for example a moving support plate 113 provided with two openings, each opening being adapted for the passage of a screwed rod 116. The position of the support plate 113 with respect to the screwed rods 116 is ensured by nuts 117. In the embodiment shown, the supporting plate is adapted for pushing the arm end upwards, whereby the clamping rod 107 is pushed downwards whereby clamping the skirt 106 of the drum 100.

In the embodiment of FIG. 10, the cover body 60 is provided with a chamber 60C adapted for receiving a bearing 60D for the rod 58.

What I claim is:

1. A beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, a support, a non rotatable shaft fixed on said support, and an intermediate part having a recess intended to receive at least part of a bearing mounted on the non rotatable shaft so that said intermediate part can swivel about the shaft, whereby said element is mounted on said intermediate part, and whereby the return mechanism is designed in order to exert a return force on an component swivelling around the non rotatable shaft selected from the group consisting of said intermediate part and components attached to said intermediate part.

2. A beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, a support, a shaft which is borne by said support and on which said element is mounted, and an intermediate part having a recess intended to receive at least part of a bearing mounted on the shaft so that said intermediate part can swivel about the shaft, whereby said element is mounted on said intermediate part, and whereby the return mechanism is designed in order to exert a return force on an component selected from the group consisting of said intermediate part and components attached to said intermediate part, in which said intermediate part is provided with a rod, while the return mechanism comprises a rolled spring blade with an inner end attached to the rod of the intermediate part and an outer end connected to the support by means of a connecting piece, said spring blade exerting a return force for moving the head away from the drum.

3. The beater of claim 2, in which the connecting piece is adapted for controlling the return force of the spring blade.

4. The beater of claim 2, in which the connecting piece is mounted rotating with respect to an axis corresponding to the axis of rotation of the element bearing the head, and in which the beater comprises a system for maintaining the connecting piece in rotated positions with respect to the axis.

5. A beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, a support, a shaft which is borne by said support and on which said element is mounted, and an intermediate part having a recess intended to receive at least part of a bearing mounted on the shaft so that said intermediate part can swivel about the shaft, whereby said element is mounted on said intermediate part, and whereby the return mechanism is designed in order to exert a return force on an component selected from the group consisting of said intermediate part and components attached to said intermediate part, in which the shaft is formed by a supporting shaft connected to the support, a hollow extending in the support as well as in the supporting shaft between two open ends, and in which the intermediate part has a rod extending through the hollow shaft and the hollow of the support, said rod having a free end extending outside of the hollow of the support, whereby the element is mounted on said intermediate part, and whereby the return mechanism is designed in order to exert a return force on an a component selected from the rod and pieces attached to the rod.

6. A beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, said return mechanism having a first part and a second part associated to each other, a support, a shaft which is borne by said support and on which said element is mounted, and an intermediate part having a recess intended to receive at least part of a bearing mounted on the shaft so that said intermediate part can swivel about the shaft, whereby said element is mounted on said intermediate part, and whereby the return mechanism is designed in order to exert a return force on an component selected from the group consisting of said intermediate part and components attached to said intermediate part, said component comprising a means of fixation for the first part of the return mechanism, said means of fixation of said first part being designed in order to fix said first part at a point which is distant from the axis of the shaft about which the intermediate part can swivel, and in which the second part of the return mechanism is connected to said support by a system which is swivel-mounted with respect to said support.

7. The beater of claim 6, which comprises a means capable of being displaced between a position which enables said system to be swivelled and a position which substantially prevents any swivelling of said system.

8. The beater of claim 6, in which the return mechanism has an inoperative position in which the first part and the second part of the return means extend substantially in a plane in which the swivelling axis of the intermediate part and the swivelling axis of the system extend.

9. The beater of claim 6, in the return mechanism has an inoperative position in which the first part and the second part of the return mechanism extend substantially along a straight line which intersects the swivelling axis of the intermediate part, and a return position in which the first part and the second part of the return mechanism extend substantially along a straight line or axis which inclined in relation to the plane in which the swivelling axis of the intermediate part and the swivelling axis of the system extend.

10. The beater of claim 9, in which a stop limits the swivelling of the system so that the return mechanism has an inoperative position in which the first part or end and the second part or end of the return means extend substantially a long a straight line which intersects the swivelling axis of the intermediate part, and a return position in which the first part or end and the second part or end of the return means extend substantially along a straight line which is inclined in relation to the plane in which the swivelling axis of the intermediate part and the swivelling axis of the system extend.

11. The beater of claim 6, in which the mechanism operated by the foot comprises a swivelling pedal, a linkage which extends between said pedal and said intermediate part, and in which said intermediate part comprises a guide means which serves to support part of the linkage and which enables the linkage to wind or unwind on said guide means during the movement of the pedal.

12. The beater of claim 11, in which said linkage is a chain, while said guide means is part of a ring gear.

13. The beater of claim 11, in which said linkage is a chain, while said guide means is part of a ring gear disposed on the intermediate part so that the distance which separates the chain from the swivelling axis of the intermediate part is a minimum in a position selected from the group consisting of position with the return mechanism in its inoperative position and position in which the head is separated from the drum.

14. The beater of claim 6, in which the first part of the return mechanism is attached to an element which is movable a long a first wall which is comprised by a part which is attached to the intermediate part.

15. The beater of claim 14, in which the part which is attached to the intermediate part is a wheel having a groove along which said element is supported, said wheel being mounted on a moveable shaft borne by a body which is fixed to the intermediate part.

16. The beater of claim 6, in which the first part of the return mechanism is attached to an element which is movable along a first wall which is comprised by a wheel which is attached to the intermediate part, said wheel having a groove along which said element is supported, said wheel being mounted on a moveable shaft borne by a body which is fixed to the intermediate part, whereby the intermediate part bears a shaft, the axis of which is substantially parallel to the swivelling axis of the intermediate part, and that the body is mounted on said shaft.

17. The beater of claim 16, in which said body is swivel-mounted on said shaft and has an inoperative position, and that said intermediate part has a striker pin which, when the intermediate part swivels in the direction in which it approaches the head of the drum, bears on said body and pushes said body into a position remote from its inoperative position.

18. A beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, the element moving according to a swivel movement of the element from a substantially stable position up to a position where the head contacts the drum, a support, and a shaft which is borne by said support and on which said element is mounted, whereby the return mechanism comprises a first part attached to an intermediate body which is at least partly swivel-mounted in relation to the swivel axis of the element, and whereby the element and the intermediate body are in relation to each other so that the return mechanism does not act on the element for a first portion of the swivel movement thereof adjacent to the stable position, while acting on the element for at least a second portion of the swivel movement different from the first portion.

19. The beater of claim 18, in which the intermediate body is mounted rotating with respect to the axis of the element, and in which the element comprises an abutment intended to contact a part of the intermediate body for said second portion of the swivel movement, while not contacting said part of the intermediate body during the first portion of the swivel movement.

20. The beater of claim 19, which is provided with a mechanism suitable for adapting the relative position between the abutment and the part of the intermediate body so as to define the first portion of the swivel movement.

21. A beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, said return mechanism having a first part and a second part associated to each other, a support, and a shaft which is borne by said support and on which said element is mounted, whereby the return mechanism is designed in order to exert a return force between a component connected to the element and piece connected to the support, whereby said component comprises a means of fixation for the first part of the return mechanism, said means of fixation of said first part being designed in order to fix said first part at a point which is distant from the axis of the element, while the piece to which the second part of the return mechanism is attached is swivel-mounted with respect to said support.

22. A beater for striking a drum, said beater comprising:

an element which is swivel-mounted in relation to an axis, said element bearing a head which is intended to strike the drum and which is connected to a mechanism operated by the foot in order to displace the head towards the drum and to a return mechanism for moving said head away from said drum, said return mechanism having a first part and a second part associated to each other, a support, and a shaft which is borne by said support and on which said element is mounted, whereby the return mechanism is a rolled spring blade.

* * * * *